US010001130B2

(12) United States Patent
Kozaki

(10) Patent No.: US 10,001,130 B2
(45) Date of Patent: Jun. 19, 2018

(54) VACUUM PUMP

(75) Inventor: Junichiro Kozaki, Kyoto (JP)

(73) Assignee: SHIMADZU CORPORATION, Kyoto-Shi, Kyoto (JP)

( * ) Notice: Subject to any disclaimer, the term of this patent is extended or adjusted under 35 U.S.C. 154(b) by 1514 days.

(21) Appl. No.: 12/923,630

(22) Filed: Sep. 30, 2010

(65) Prior Publication Data

US 2011/0044826 A1 Feb. 24, 2011

Related U.S. Application Data

(62) Division of application No. 11/606,015, filed on Nov. 30, 15, now abandoned.

(30) Foreign Application Priority Data

Sep. 17, 2004 (JP) ..... 2004-271680

(51) Int. Cl.
*F04D 19/04* (2006.01)
*F04D 29/058* (2006.01)
*F04D 27/02* (2006.01)

(52) U.S. Cl.
CPC ..... *F04D 29/058* (2013.01); *F04D 19/042* (2013.01); *F04D 27/0292* (2013.01)

(58) Field of Classification Search
CPC ..... F04D 15/0245; F04D 15/0263; F04D 15/0272; F04D 15/0281; F04D 19/042; F04D 27/0292
USPC ..... 417/12, 32
See application file for complete search history.

(56) References Cited

U.S. PATENT DOCUMENTS 6,416,290 B1 * 7/2002 Yamauchi ..... 417/32

FOREIGN PATENT DOCUMENTS

| | | |
|---|---|---|
| JP | S49-102390 | 9/1974 |
| JP | U-S53-133690 | 10/1978 |
| JP | S57-122326 | 7/1982 |
| JP | 07005051 A * | 1/1995 |
| JP | 2000-018189 | 1/2000 |
| JP | 2003-274625 | 9/2003 |

(Continued)

OTHER PUBLICATIONS

Machine Translation of JP 07005051 A.*

(Continued)

*Primary Examiner* — Dominick L Plakkoottam
*Assistant Examiner* — Philip Stimpert
(74) *Attorney, Agent, or Firm* — Manabu Kanesaka

(57) ABSTRACT

A vacuum pump configured to exhaust gas includes an inductance gap sensor positioned oppositely near an end face of a rotational axis of a rotational body including a rotor; a plurality of individually formed recesses disposed at the end face facing the gap sensor at respectively different angular positions; and at least one ferromagnetic body disposed in at least one of the recesses. The ferromagnetic body has a Curie temperature approximately equal to an allowable temperature of the rotor. The gap sensor senses inductance changes associated with changes in magnetic permeability of the ferromagnetic body to detect a temperature of the rotor. One of the recesses where the ferromagnetic body is not disposed is a rotational number sensor target. Thus, a rotational number of the rotor is detected based on a change in inductance when the rotational number sensor target passes opposite the inductance sensor.

5 Claims, 12 Drawing Sheets

(56) References Cited

FOREIGN PATENT DOCUMENTS

| | | | | |
|---|---|---|---|---|
| JP | 2004-069462 | | 3/2004 | |
| JP | 2004-116319 | | 4/2004 | |
| JP | 2006083825 A | * | 3/2006 | |
| JP | 2006083825 A | * | 3/2006 | ..... F04D 19/04 |

OTHER PUBLICATIONS

Machine Translation of JP 2006083825 A.*
Machine translation of above reference, retrieved on Dec. 20, 2017 from https://dossier1.j-platpat.inpit.go.jp/tri/all/odse/ODSE_GM101_Top.action.*

* cited by examiner

VACUUM PUMP

CROSS-REFERENCE TO RELATED APPLICATION

This is a divisional application of patent application Ser. No. 11/606,015 filed on Nov. 30, 2006.

BACKGROUND OF THE INVENTION AND RELATED ART STATEMENT

The present invention relates to vacuum pumps, and more specifically, relates to vacuum pumps that use the change in the magnetic permeability of a ferromagnetic body to determine a rotor temperature and/or control rotor rotation.

In a turbo-molecular pump used for example in semiconductor manufacturing equipment, as the flow rate or molecular weight of the gas exhausted by the turbo-molecular pump increases, the rotor temperature increases due to heat generated in association with an increase in motor electricity or frictional heat associated with gas exhaust. Also, even in a case wherein the gas with little thermal conductivity is exhausted, the rotor temperature increases. Generally, the higher the number of rotor revolutions, flow rate, pressure, temperature of exhaust gas, and pump ambient temperature, the higher the rotor temperature.

Since the rotor of a turbo-molecular pump rapidly rotates, centrifugal force results in large tension stress. Therefore, an aluminum alloy having an excellent specific strength is generally used as the rotor material. However, an allowable temperature of creep deformation for an aluminum alloy is relatively low (approximately 110° C.~120° C.). Therefore, an operating pump must be constantly monitored to verify that the rotor temperature stays below the allowable temperature.

A contactless method for detecting rotor temperature is known and uses the fact that the magnetic permeability of the ferromagnetic body greatly changes at the Curie temperature.

For example, Japanese Patent Publication No. H7-5051 discloses a device in which a ring-shaped ferromagnetic body is disposed around a rotor. The changes in magnetic permeability of the ferromagnetic body is detected by a coil as the temperature reaches the Curie temperature.

However, because the ring-shaped ferromagnetic body is installed around the rotor, a high degree of tension stress, due to a centrifugal force, acts on the ferromagnetic body, and may possibly damage the ferromagnetic body.

The present invention has been made to solve the above conventional problems.

SUMMARY OF INVENTION

A first aspect of the invention includes a vacuum pump exhausting gas by rotating a rotor relative to a stator and includes a ferromagnetic body provided on a rotational axis or near the rotational axis of an end face of the rotational axis direction of a rotational body that includes a rotor whose Curie temperature is approximately equal to an allowable temperature of the rotor. A detecting portion is provided in such a way as to oppose the ferromagnetic body and detects changes in magnetic permeability of the ferromagnetic body as the inductance changes.

A second aspect applies to a vacuum pump exhausting the gas by rotating the rotor relative to the stator and includes a revolution sensor target provided near the rotational axis of the end face of the rotational axis direction of the rotational body, the rotational body including a rotor. A ferromagnetic body is provided in a position wherein a radial directional distance from the rotational axis of the rotor is approximately equal to the radial directional distance of the revolution sensor target. The Curie temperature of the rotor is approximately equal to the allowable temperature of the rotor and an inductance-type revolution sensor is disposed in such a way as to be opposed to the revolution sensor target and the ferromagnetic body. The revolution sensor detects the number of revolutions of the rotor and the change in the magnetic permeability of the ferromagnetic body, as the inductance changes.

A third aspect includes the vacuum pump as disclosed in the first aspect, wherein the ferromagnetic body is provided on the end face of the rotor in such a way that the inductance, when the detecting portion and the ferromagnetic body are opposed to each other, becomes smaller than the inductance when the detecting portion and the end face of the rotor are opposed to each other, when the temperature of the rotor is lower than the Curie temperature.

A fourth aspect includes the vacuum pump of the first aspect and further includes a control means that reduces the rotational speed of the rotor, or halts the rotation of the rotor, when the change of the magnetic permeability of the ferromagnetic body is detected.

A fifth aspect includes the control means halting the rotation of the rotor when an integration of time wherein the change of the magnetic permeability of the ferromagnetic body is detected, exceeds a predetermined allowable time based on the creep life design of the rotor.

A sixth aspect includes an alarm means for presenting alarm information that indicates an abnormality of the pump when a change of the magnetic permeability of the ferromagnetic body is detected.

A seventh aspect includes a detecting portion provided in such a way as to be opposed to the first and second ferromagnetic bodies, wherein the Curie temperature of the second ferromagnetic is high than the Curie temperature of the first ferromagnetic. The detecting portion detects the change in magnetic permeability of the first and second ferromagnetic bodies as inductance changes. In addition, a control means is included that halts the rotation of the rotor when a change in magnetic permeability of the second ferromagnetic body is detected, and/or when the integration time of when the change of the magnetic permeability of the first ferromagnetic body is detected exceeds a predetermined allowable time based on the creep life design of the rotor.

Because the ferromagnetic body is provided on or near the rotational axis of the end face of the rotational axis direction of the rotational body, a tension stress acting on the ferromagnetic body can be controlled and durability of the ferromagnetic body can be improved. Moreover, because the revolution sensor detects the change of the magnetic permeability of the ferromagnetic body as the inductance changes, an increase in the number of parts and an increase in cost may be prevented.

BRIEF DESCRIPTION OF THE DRAWINGS

FIGS. 2A and 2B are drawings showing portions of a nut, wherein FIG. 2A is a cross sectional view and FIG. 2B shows the bottom face of the nut;

FIGS. 9A and 9B illustrates a second embodiment of the vacuum pump, wherein FIG. 9A is a cross sectional view of the nut and a gap sensor, and FIG. 9B is a view taken along 9B of the nut;

FIGS. 12A and 12B illustrate a third embodiment of the vacuum pump, wherein FIG. 12A is a cross sectional view of a nut and gap sensor, and FIG. 12B shows the bottom face of the nut;

DETAILED DESCRIPTION OF EMBODIMENTS

Figure 1:
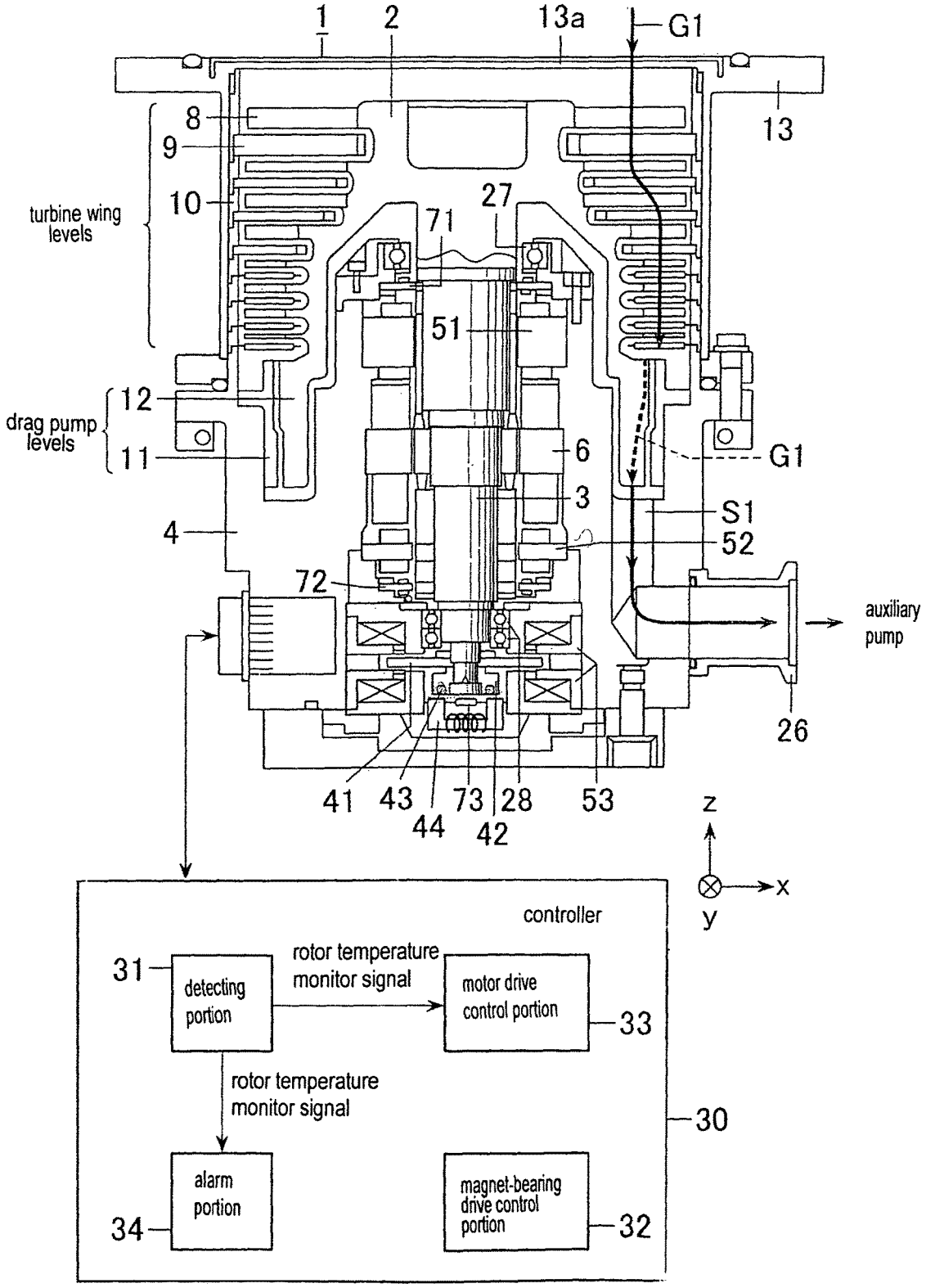
FIG. 1 is a drawing of one embodiment of a vacuum pump according to the present invention.

FIG. 1 is a drawing showing an embodiment of a vacuum pump according to the present invention, and shows a schematic structure of a pump main body 1 of a magnet-bearing type turbo-molecular pump and a controller 30.

A shaft 3 comprising an attached rotor 2 contactlessly supported by electric magnets 51, 52, 53 is provided on a base 4. The floating position of the shaft 3 is detected by radial displacement sensors 71, 72 disposed on the base 4 in addition to an axial displacement sensor 73. Electric magnets 51, 52 each comprise a radial magnet bearing further comprising five axis-control magnet bearings. The electric magnet 53 constitutes an axial magnet bearing and displacement sensors 71-73.

At a lower end of the shaft 3, a circular disk 41 is provided, and the electric magnet 53 is provided in such a way as to sandwich the disk 41 from above and below. The shaft 3 is floated in an axial direction by operation of the disk 41 being attracted by the electric magnet 53. The disk 41 is fixed to the lower end portion of the shaft 3 by a nut 42.

Figure 2A:
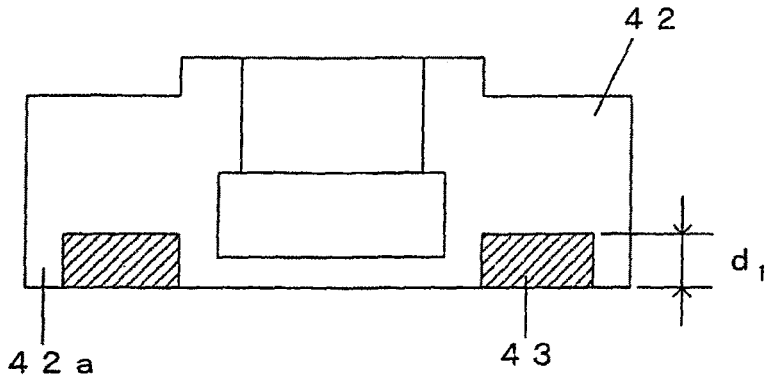
Figure 2B:
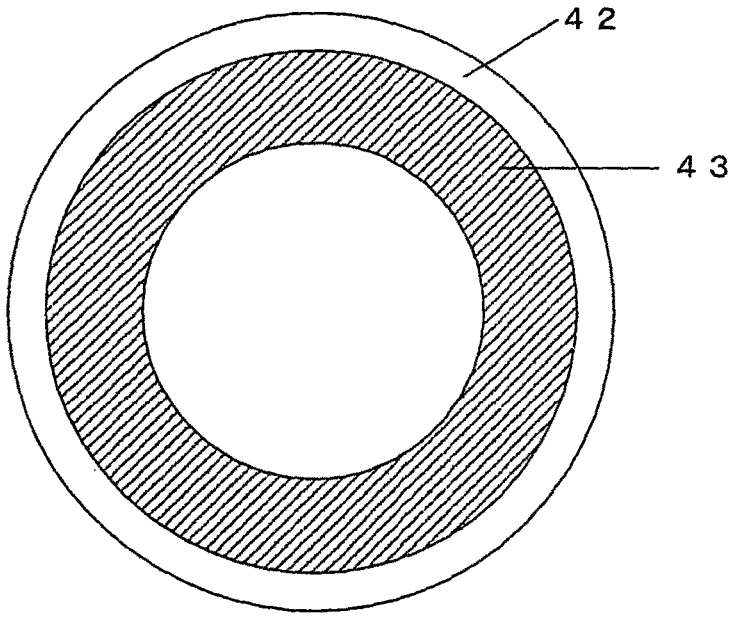

As shown in FIGS. 2A, 2B, a ring-shaped ferromagnetic body target 43 is provided on the lower end face of the nut 42. The target 43 is embedded in the nut 42 by adhesion, or fixed to the nut 42 by heating the nut 42 side and carrying out shrinkage fitting. When the nut 42, along with shaft 3, is rapidly rotated, a centrifugal force acts on the target 43 in a horizontal direction, as shown in the drawings. However, since the target 43 is provided in the end face portion of a rotational body, the target 43 may be provided near the axis, so that the effect of the centrifugal force may be reduced. Moreover, since the side face of the target, which is the direction of centrifugal action, is retained by a retaining portion 42*a* of the nut 42, tension stress generated in the target 43 may be controlled, improving durability of the target 43.

Especially in the case wherein the target 43 is shrunk fit, because compressive stress acts on the target 43, the effect of the centrifugal force can be reduced. Also, the target 43 is provided on the end face of the shaft 3, so that the outward form of the target 43 can be reduced regardless of the diameter of the shaft 3, and the target 43 can be provided near the axis of the shaft 3. Hereby, the effect of the centrifugal force may be reduced.

On the stator side, an inductance-type gap sensor 44 is provided in such a way as to be opposed to the target 43 provided in the nut 42. As described below, the gap sensor 44 detects the change of the magnetic permeability, e.g., an inductance change, of the target 43 when the rotor temperature is increased more than an allowable temperature.

Figure 8:
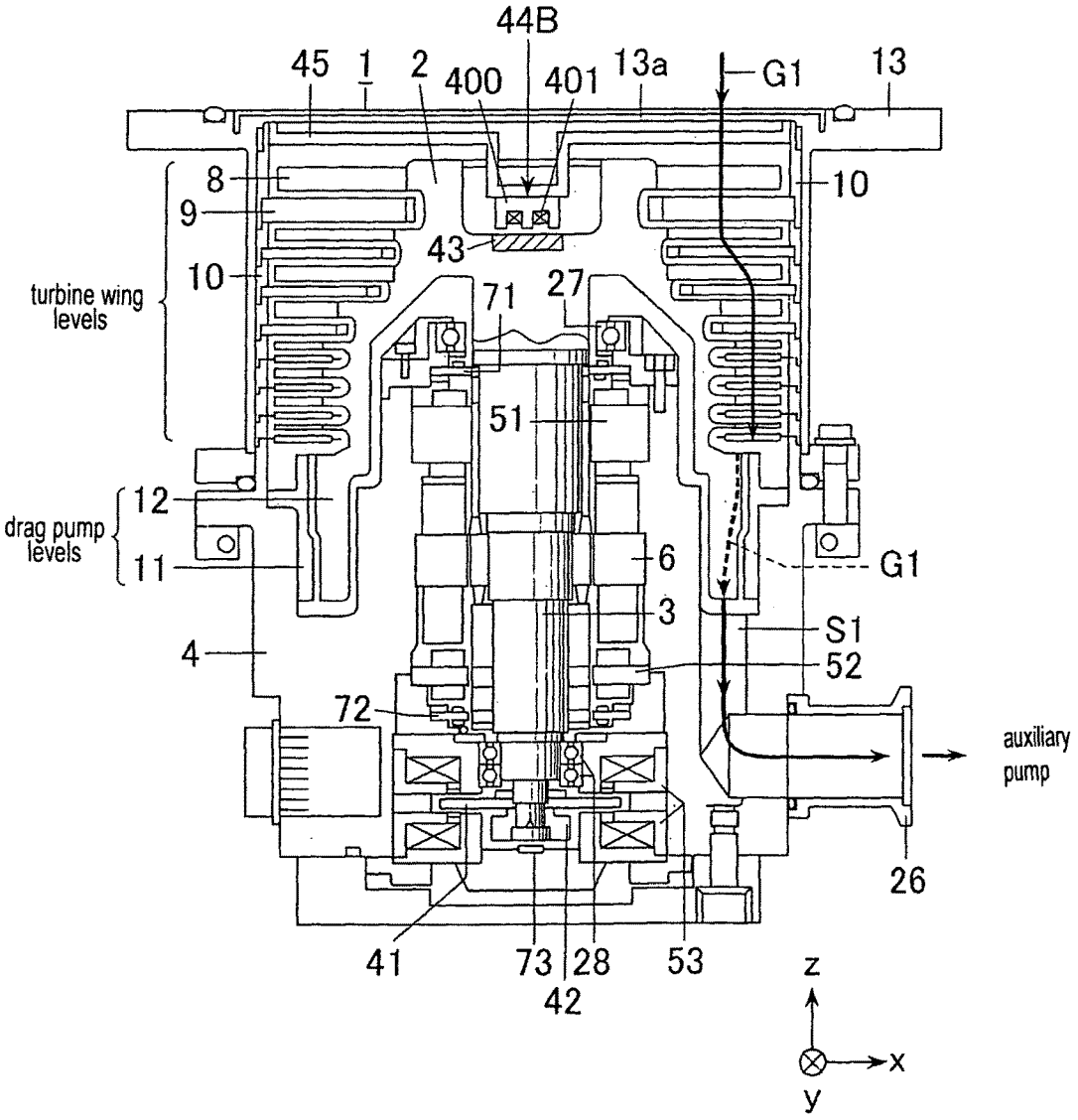
FIG. 8 is a cross sectional view of the pump, wherein a target is provided on the upper end face of a rotor.

In the pump shown in FIG. 1, the target 43 is provided on the end face of the lower side of the disk 41 provided in the shaft 3. However, as shown in FIG. 8, the upper end face of the rotor 2 may be also provided with the target 43 on the axis of the rotor. In this case, the target 43 may be discoidal and not ring-shaped, and the side face of the target 43, upon which the centrifugal force acts, is retained by the rotor 2. More specifically, the rotor 2 functions as the retaining portion of the target 43. A gap sensor 44B is retained on the axis of the rotor by a support 45 fixed to a spacer 10 on the highest level. The gap sensor 44B has a structure wherein coils 401 are rolled around in the center of the projection of a core 400. Because the target 43 in FIG. 8 is provided on the rotor axis, the target 43 in FIG. 8 may reduce the effect of the centrifugal force more than the target 43 shown in FIG. 1.

In the rotor 2 in FIG. 1, rotating wings 8 with multiple levels are formed along a direction of a rotational axis. Fixed wings 9 are respectively provided between the rotating wings 8 lined up above and below. Durbin wing levels of the pump main body 1 are formed by the rotating wings 8 and fixed wings 9. Each fixed wing 9 is retained by spacers 10 in such a way as to be clamped above and below. The spacers 10 maintain gaps between the fixed wings 9 at predetermined intervals and function to maintain the position of the fixed wings 9.

Moreover, screw stators 11 are provided in back levels (below in the figure) of the fixed wings 9, and comprise drag pump levels. Gaps are formed between inner circumferential surfaces of the screw stators 11 and a cylinder portion 12 of the rotor 2. The fixed wings 9 retained by the rotor 2 and the spacers 10 are housed inside a casing 13 wherein an inlet 13*a* is formed. The shaft 3 is contactlessly supported by electric magnets 51~53. When the shaft 3, to which the rotor 2 is attached, is rotated by a motor 6, gas on an inlet 13*a* side is exhausted to a back-pressure side (space S1) in the manner of an arrow G1. The gas exhausted to the back-pressure side is exhausted through an auxiliary pump connected to an outlet 26.

The turbo-molecular pump main body 1 is controlled by the controller 30. Controller 30 comprises a magnet-bearing drive control portion 32 controlling the magnet bearings; and a motor drive control portion 33 controlling the motor 6. A detecting portion 31 detects whether the magnetic permeability of the target 43 is changed or not, based on an output signal of the gap sensor 44.

The output signal of the gap sensor 44 is input into the detecting portion 31, and a rotor temperature monitor signal is output into the motor drive control portion 33 and an alarm portion 34. In some embodiments, an output terminal configured to output the rotor temperature monitor signal to the outside of the controller 30 may be provided. The alarm portion 34 is an alarm means presenting alarm information, such as an abnormal rotor temperature, etc., to an operator, and may comprise a display unit displaying a warning message or may comprise a speaker releasing a warning sound, or a warning and so on.

Figure 3:
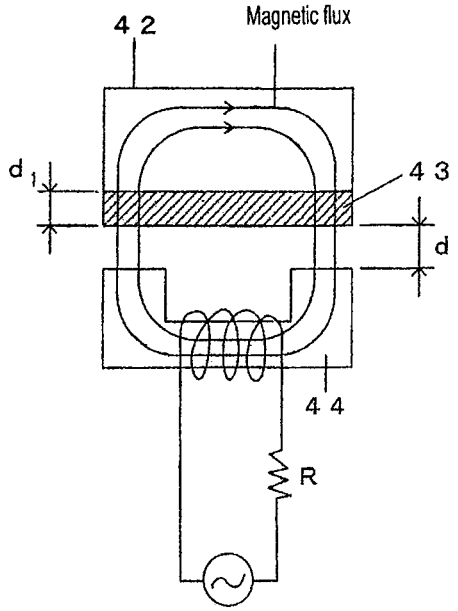
FIG. 3 is a drawing depicting inductance changes of a gap sensor.

FIG. 3 illustrates an inductance change of the gap sensor 44, and a pattern diagram of a magnetic circuit that may be made by the gap sensor 44 and the target 43. The gap sensor 44 is formed by furling a coil around a core with large magnetic permeability such as a silicon steel plate. A high-frequency voltage with constant frequency and a constant voltage may be applied to the coil of the gap sensor 44 as a carrier wave, and a high-frequency magnetic field may be formed between the gap sensor 44 and the target 43.

The material that comprises the ferromagnetic body includes a Curie temperature Tc that is approximately the same temperature as the allowable temperature Tmax of the rotor 2, or near the allowable temperature Tmax of the rotor 2, and comprises the material of the target 43. In the case of the rotor 2, the allowable temperature Tmax which generates a creep deformation in the rotor material, is used. In the case of aluminum, the allowable temperature Tmax is approximately 110° C.~120° C. Nickel and zinc ferrite, or manganese and zinc ferrite and so on are used for materials of the ferromagnetic body wherein a Curie temperature Tc is approximately 120° C.

Figure 4:
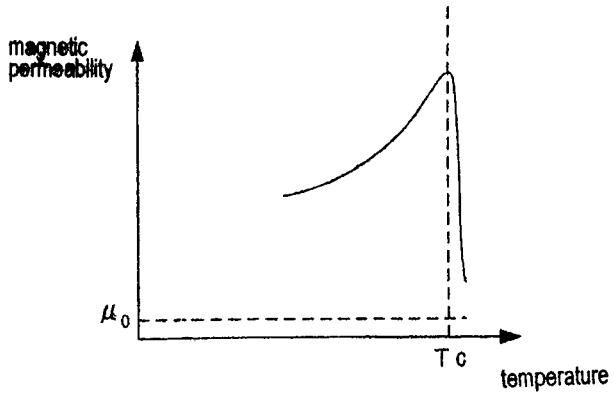
FIG. 4 is a drawing showing a relationship between a Curie temperature Tc and magnetic permeability.

FIG. 4 illustrates wherein the magnetic permeability of a target 43 rapidly decreases to approximately a vacuum magnetic permeability $\mu_o$ when the temperature of the target 43 increases to a temperature near the Curie temperature Tc. Such an increase may be due, for instance, to an increase of the rotor temperature. When the magnetic permeability of the target 43 changes as a result of the magnetic field formed by the gap sensor 44, the inductance of the gap sensor 44 changes. As a result, the carrier wave is amplitude-modulated, and the amplitude-modulated carrier wave that is output from the gap sensor 44 is detected and rectified. Therefore, a signal change corresponding to the change of the magnetic permeability can be detected.

The ferromagnetic body, such as ferrite, etc., may be used as the core material of the gap sensor 44. However, in the case wherein the magnetic permeability is larger than the magnetic permeability of the air gap, it may be possible to ignore the magnetic permeability of the air gap. Furthermore, in the case wherein the leakage flux can be ignored, the relationship between inductance L and dimensions d, $d_1$ are shown approximately in the following formula (1), wherein N represents the furled number of the coil, S represents a cross-sectional area of the core opposed to the target 43, d represents the air gap, $d_1$ represents the thickness of the target 43, $\mu_1$ represents the magnetic permeability of the target 43, and the magnetic permeability of the air gap is equivalent to the vacuum magnetic permeability $\mu_o$.

$$L=N^2/\{d_1/(\mu_1\cdot S)+d/(\mu_o\cdot S)\} \quad (1)$$

When the rotor temperature is lower than the Curie temperature Tc, the magnetic permeability of the target 43 is sufficiently large compared to the vacuum magnetic permeability $\mu_o$. As a result, $d_1/(\mu_1\cdot S)$ decreases to the degree of being able to be ignored compared to $d/(\mu_o\cdot S)$, so that formula (1) can approximate to the following formula (2):

$$L=N^2\cdot\mu_o\cdot S/d \quad (2)$$

On the other hand, when the rotor temperature rises more than the Curie temperature Tc, approximately $\mu_1=\mu_o$.

Therefore, in this case, formula (1) is represented in the following formula (3):

$$L=N^2\cdot\mu_o\cdot S/(d+d_1) \quad (3)$$

More specifically, the air gap has changed from d to $(d+d_1)$, and the inductance of the gap sensor 44 changes accordingly. Whether or not the rotor temperature exceeds the Curie temperature Tc may be monitored by detecting the inductance change at the detecting portion 31 of the controller 30.

Figure 5:
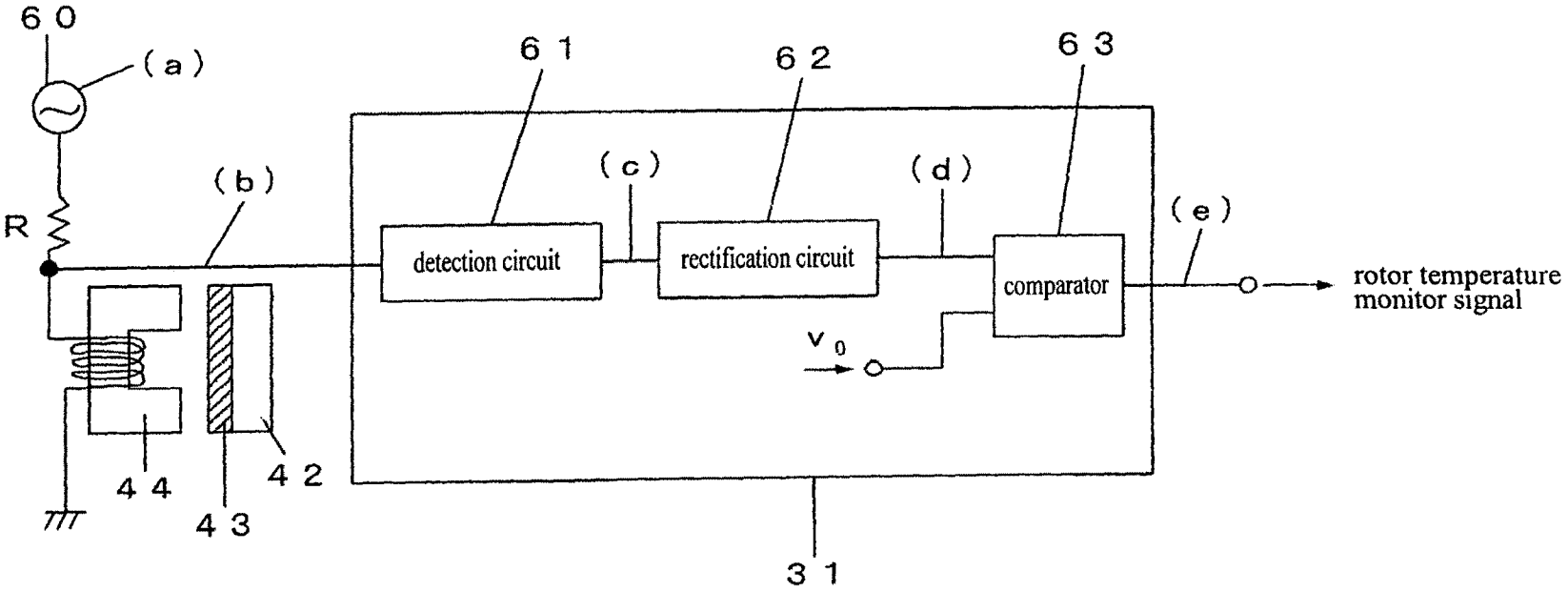
FIG. 5 is a block diagram of a detecting portion.
Figure 6A:
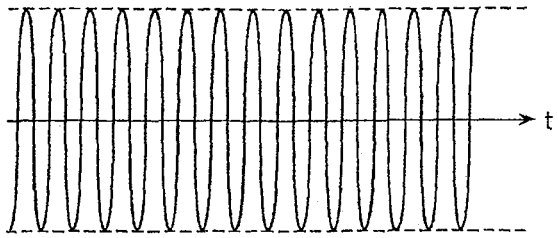
FIGS. 6A-6E show signal waveforms based upon the block diagram of FIG. 5.
Figure 6B:
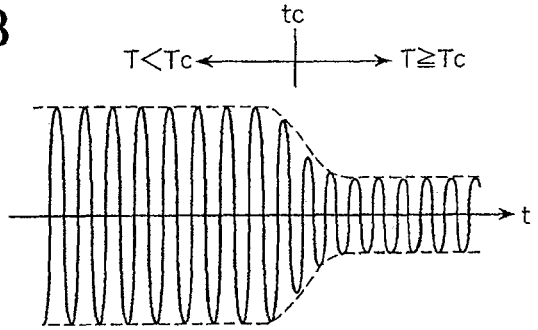

FIG. 5 is a block diagram of the detecting portion 31, and FIGS. 6A-6E illustrate signal waveforms A-E generated based upon the block diagram of FIG. 5. When the carrier wave as shown in FIG. 6A is applied to the gap sensor 44 by a power source 60, gap sensor 44 outputs modulation waves, as shown in FIG. 6B. When the rotor temperature T exceeds the Curie temperature Tc at time tc, the magnetic permeability $\mu_1$ of the target 43 decreases such that $\mu_1$ approximately equals $\mu_o$. Accordingly, the inductance L decreases from a value shown in the formula (2) to a value shown in the formula (3), decreasing the amplitude of the carrier wave.

Figure 6C:
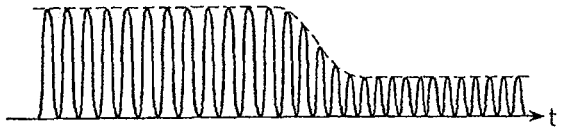
Figure 6D:
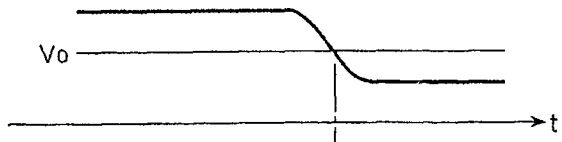
Figure 6E:
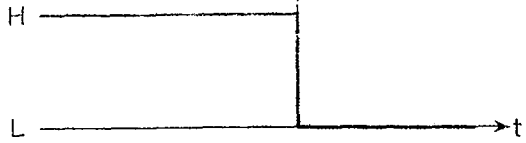

By inputting the signal in FIG. 6B into a detection circuit 61, a signal shown in FIG. 6C may be obtained. Moreover, by processing the signal in FIG. 6C, e.g., by a rectification circuit 62, a smooth signal as shown in FIG. 6D may be obtained that may serve as an input into a comparator 63. The comparator 63 compares an input signal with the threshold Vo, and when the level of the input signal exceeds the threshold Vo, the comparator 63 outputs a signal of v=H. When the level of the input signal is decreased to be less than the threshold Vo, the comparator 63 outputs a signal of v=L (refer to FIG. 6E). A signal output from the comparator 63 is output to the motor drive control portion 33 and the alarm portion 34 as the rotor temperature monitor signal.

Pump Operation

A method for safely operating a turbo-molecular pump by using a rotor temperature monitor signal t output from a detecting portion 31, is disclosed below.

Operation Example 1

The operation example 1 is the easiest operation. When the rotor temperature monitor signal v becomes v=L, the motor drive control portion 33 immediately reduces the speed of the rotation of a rotor 2, stopping the rotor 2. An alarm portion 34 informs abnormality of the rotor temperature. When the rotor temperature T becomes the allowable temperature Tmax and there are significant creep deformations, the generation of the above-mentioned creep deformations may be prevented by stopping the rotation of the rotor, improving the safety of the pump.

Operation Example 2

In the operation example 1, the rotor temperature monitor signal is v=L and the rotation of the rotor is stopped. However, the revolution of rotor 2 may be decreased only during the signal of v=L, and may be returned to the rated speed again at a time wherein the rotor temperature monitor signal becomes v=H. When the rotor temperature T exceeds the Curie temperature Tc, creep deformation of the rotor 2 due to the centrifugal force may be controlled by decreasing the number of revolutions. In addition, when the number of revolutions is decreased to be less than the rated speed, not only is the increased rotor temperature information displayed, but the operator may be alerted by displaying the number of decreased revolutions in the alarm portion 34.

Also, when the turbo-molecular pump is used to etch equipment and so on, a reaction product may be easily attached to the inside of the pump. As the temperature of the pump decreases, the pump main body may be heated by a heater and the like, helping to prevent reaction product from being attached. Consequently, instead of a decrease of the rotor revolution, or with a decrease of the rotor revolution, a heating means such as a heater and the like, may be halted only during the signal of v=L.

Operation Example 3

In the operation examples 1, 2, when the rotor temperature monitor signal becomes v=L, the rotation of the rotor may be stopped, or the rotor revolution may only be decreased when the signal of v=L. However, there is a case wherein the rotation of the rotor cannot be changed due to being in the middle of the process on a semiconductor equipment side. As an example, when an integrated value of the time when the signal is v=L becomes the predetermined criterion time, the rotor 2 is halted and the generation of the abnormality is informed by the alarm portion 34.

Therefore, even when temperature T become wherein T≥Tc during the process, if the integrated time is within the criterion time, the process can be continued without change.

The criterion time is the time to reach allowable deformation volume of the rotor 2 and is obtained beforehand by the creep life design of the rotor. However, since the creep deformation differs depending, for example, on the temperature, the criterion time may be calculated based upon the condition that the rotor temperature T is the Curie temperature Tc, or may be a shorter time than the previously-described time.

Modified Example 1

Figure 7:
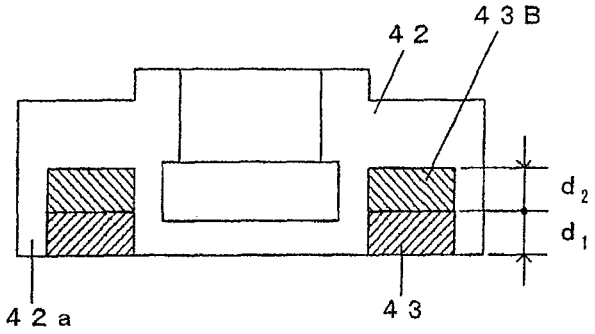
FIG. 7 is a modified first example of the vacuum pump.

FIG. 7 is a cross sectional view of a nut 42 comprising the turbo-molecular pump. Other than nut 42, the structure of the pump main body 1 of FIG. 7 is the same as the structure shown in FIG. 1. In the modified example 1, in addition to the target 43, a target 43B with a high Curie temperature is added to the nut 42, as a target of the gap sensor 44. In this case, formula (4) shown below may be approximately replaced by the above-described formula (1). The thickness of the target 43B may be $d_2$, the magnetic permeability is $\mu_2$, and the Curie temperature is Tc', wherein Tc'>Tc.

$$L=N^2/\{d_1/(\mu_1\cdot S)+d_2/(\mu_2\cdot S)+d/(\mu_0\cdot S)\} \quad (4)$$

When the rotor temperature T exceeds the Curie temperature Tc, approximately $\mu_1=\mu_2=\mu_0$ so that the inductance L of the gap sensor 44 changes as follows depending on the rotor temperature T.

$$(T<Tc)L=N^2\cdot\mu_0\cdot S/d$$

$$(Tc\leq T<Tc')L=N^2\cdot\mu_0\cdot S/(d+d_1)$$

$$(T\geq Tc')L=N^2\cdot\mu_0\cdot S/(d+d_1+d_2)$$

In the case of the modified example 1, by conducting the following control action, the pump can be more safely operated. More specifically, the time wherein the inductance is L1 is integrated, and in the case wherein the integrated time is within the criterion time, the operation is continued, and when the integrated time exceeds the criterion time, the rotation of the rotor 2 is halted. However, in the case wherein the rotor temperature T exceeds the Curie temperature Tc' of the target 43B, even if the integrated time is within the criterion time, the rotation of the rotor 2 is halted. This is because the creep deformation also becomes significant, such as when the rotor temperature T becomes the Curie temperature Tc', which is furthermore higher than the allowable temperature Tmax. Accordingly, the rotor 2 is immediately halted for safety. Motor drive control portion 33 is configured to calculate the integrated time.

Modified Example 2

Figure 9A:
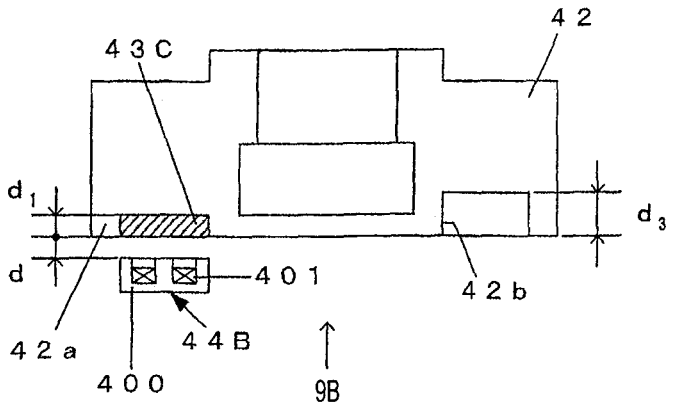
Figure 9B:
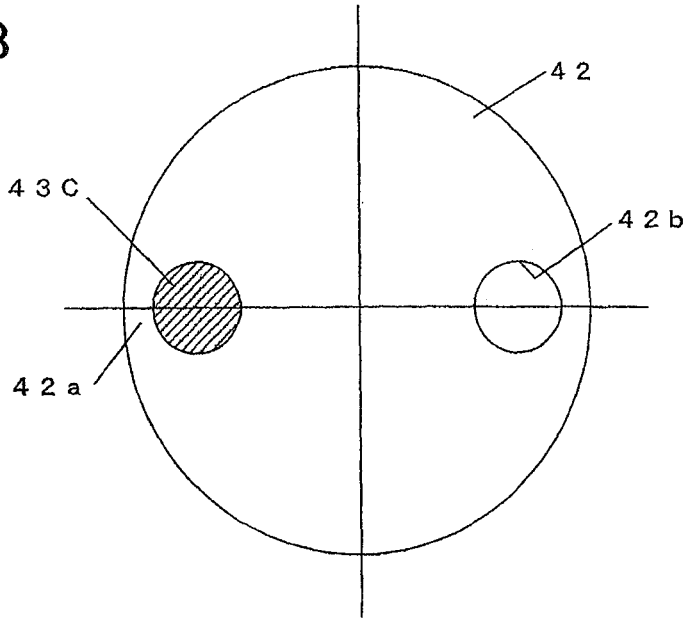

FIGS. 9A and 9B illustrate a modified example 2 of the turbo-molecular pump. FIG. 9A is a cross sectional view of the nut 42 and a gap sensor 44B. FIG. 9B is a view taken along B of the nut 42. The structure of the pump main body 1, other than the nut 42 and the gap sensor 44B, is the same as the structure shown in FIG. 1, and the structure of the gap sensor 44B is the same as the structure shown in FIG. 8.

On the bottom face of the nut 42, a target 43C for monitoring the rotor temperature and a depression 42*b*, which is a revolution sensor target for monitoring the rotor rotation, are provided relative to one gap sensor 44B. The discoid target 43C has a thickness $d_1$, and a circular depression 42*b*, with a depth $d_3$, is provided in a position of rotational symmetry through 180 degrees relative to the central axis of the nut 42, and when the nut 42 rotates. The target 43C and the depression 42*b* are alternately opposed relative to the gap sensor 44B. More specifically, in the modified example 2, the gap sensor 44B functions as a revolution sensor and as a sensor that monitors the rotor temperature. $D_1$ and $d_3$ are set such that $d_3>d_1$. Although the target 43C is described as a disk and the depression 42*b* is disclosed as a circle, the target 43C and the depression 42*b* are not limited to the above-mentioned shapes.

Figure 10:
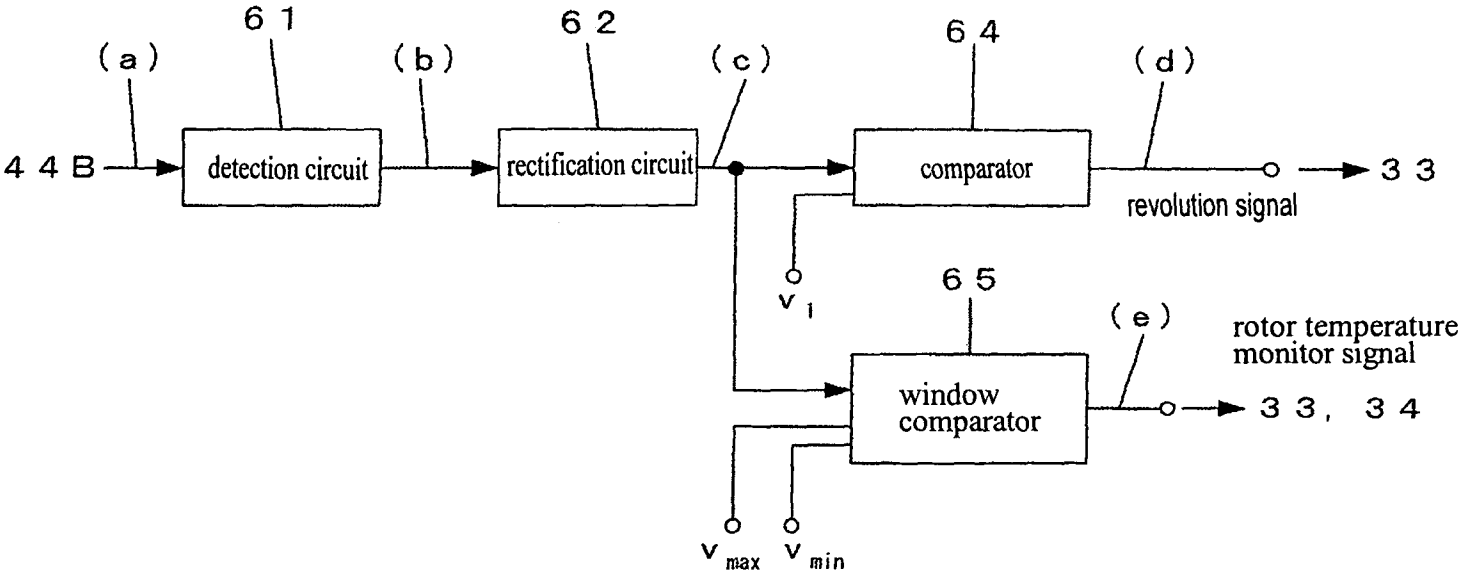
FIG. 10 is a block diagram of a detecting portion according to the modified second example of FIGS. 9A and 9B.

FIG. 10 is a block diagram of the detecting portion 31 according to FIG. 1, and FIG. 11 illustrates the signal waveforms a-e, referenced in the block diagram of FIG. 10. In FIG. 11, the reference tc represents a time wherein the temperature of the target 43C exceeds the Curie temperature Tc. Before time tc (shown in the left side of the figures) the rotor temperature T is defined wherein T<Tc. After time tc (shown in the right side of the figures), the rotor temperature T is wherein T≥Tc.

A carrier wave signal as shown as FIG. 6A, is applied to the gap sensor 44B, as signal (b) of FIG. 5. The carrier wave is modulated by the gap sensor 44B, and modulation waves shown as in FIG. 11 are output from the gap sensor 44B. The inductance L of the gap sensor 44B differs depending on which part of the nut 42 is opposed to the gap sensor 44B. When the rotor temperature T fulfils the equation wherein T<Tc relative to the Curie temperature Tc of the target 43C, the inductance L changes as the following formula.

(Opposed to Bottom Face of Nut 42) $L=N^2\cdot\mu_o\cdot S/d$ (Opposed to Depression 42*b*) $L1=N^2\cdot\mu_o\cdot S/(d+d_3)$ (Opposed to Target 43*C*) $L=N^2\cdot\mu_o\cdot S/d$ On the other hand, when the rotor temperature T is where T≥Tc, the inductance L changes as the following formula, wherein the relative sizes of the inductances L, L1, L2 are L>L2>L1. In other words, sizes $d_1$ and $d_3$ are set in order to meet the condition of L>L2>L1.

Figure 11A:
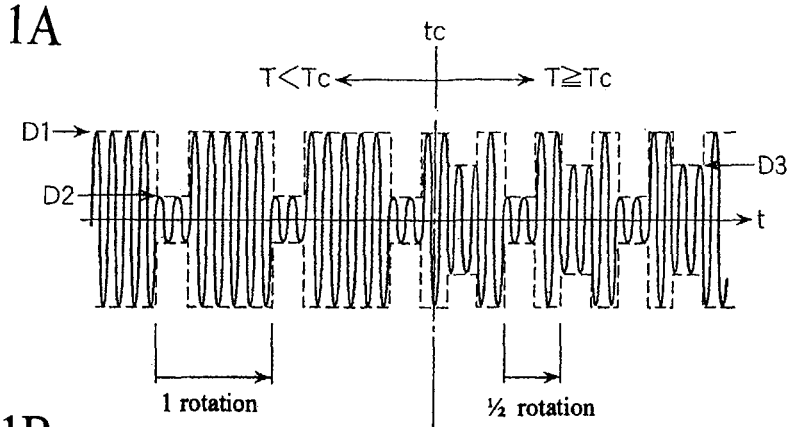
FIGS. 11A-11E illustrates signal waveforms based upon the block diagram of FIG. 10.

(Opposed to Bottom Face of Nut 42) $L=N^2\cdot\mu o\cdot S/d$ (Opposed to Depression 42*b*) $L1=N^2\cdot\mu o\cdot S/(d+d_3)$ (Opposed to Target 43*C*) $L2=N^2\cdot\mu o\cdot S/(d+d_1)$ Therefore, in signal of FIG. 11A, on the left side of the time tc, portions of signal levels D1 and signal levels D2 corresponding to the inductances L, L1 appear on the modulation waves. On the other hand, in the field of the right side of the time tc wherein the time tc becomes T≥Tc, portions of signal levels D3 corresponding to the inductance L2 appear on the modulation waves in addition to the signal levels D1, D2. The signal levels D2 are generated each time the nut 42 makes one revolution, and an interval between each signal level D2 and each signal level D3 corresponds to a one-half revolution.

Figure 11B:
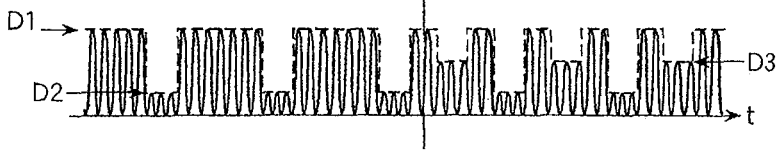

If the modulation waves (a) shown in FIG. 11A are passed through the detection circuit 61 shown in FIG. 10, signals as shown in FIG. 11B can be obtained. Moreover, by processing signal of FIG. 11B at the rectification circuit 62, signal of FIG. 11C can be obtained. The signal (c) of FIG. 10 is output from the rectification circuit 62 and is divided into two sections. The signals serve as respective inputs to a comparator 64 for detecting a rotational signal and a window comparator 65 for detecting a temperature monitor signal.

The comparator 64 compares input signal of FIG. 11C with the threshold $V_1$, and when the signal level is below the threshold $V_1$, a signal of FIG. 11D, having a signal level H, is output. When the signal level is larger than the threshold $V_1$, a signal L is output. In this case, the signal H is output only at the time of the signal level D2, and in other cases, the signal L is output. Accordingly, pulse signals of FIG. 11D are output at the motor drive control portion 33 in FIG. 1 from the comparator 64, as a revolution signal.

Figure 11C:
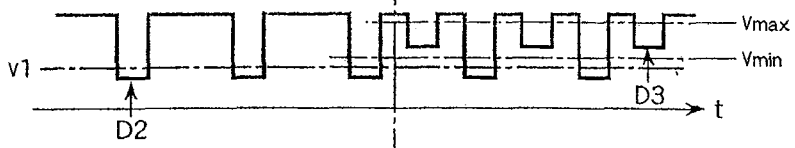
Figure 11D:
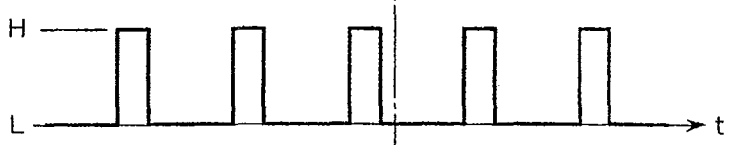
Figure 11E:
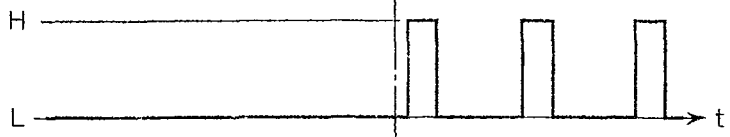

Pulses as shown in signal of FIG. 11D are output when the signal level is D2, i.e., when the gap sensor 44B is opposed to the target 43C. Accordingly, each time the rotor 2 rotates once, pulses are output. These pulses are constantly output, regardless that the rotor temperature T is higher or lower than the Curie temperature Tc. In the motor drive control portion 33, the rotor revolution can be obtained by counting these pulses.

The window comparator 65 that detects the temperature monitor signal compares the input signal (c) with the threshold Vmax and Vmin. When the signal level is over Vmin and below Vmax, a signal level H is output, and when the signal level is smaller than the threshold Vmin or greater than the threshold Vmax, the signal L is output (see signal of FIG. 11E). Therefore, pulse signals as shown in FIG. 11F are output at the motor drive control portion 33 and the alarm portion 34 from the window comparator 65, as the rotor temperature monitor signal.

As signal of FIG. 11C shows, the signals of level D3 are output only when the rotor temperature T exceeds the Curie temperature Tc. Accordingly a pulse is generated only at the time of T≥Tc, regardless of whether or not the rotor temperature T, where T≥Tc can be determined by detecting the pulse.

Conventionally, there was no device able to be used for both the gap sensor and the revolution sensor of the ferromagnetic body for detecting the temperature; however, in the above-mentioned modified example 2, gap sensor 44B is provided as a revolution sensor and is used for detecting the rotor temperature. As a result, costs based on additional components can be controlled. Furthermore, there is no need for providing a new space for a sensor for detecting the rotor temperature.

Modified Example 3

Figure 12A:
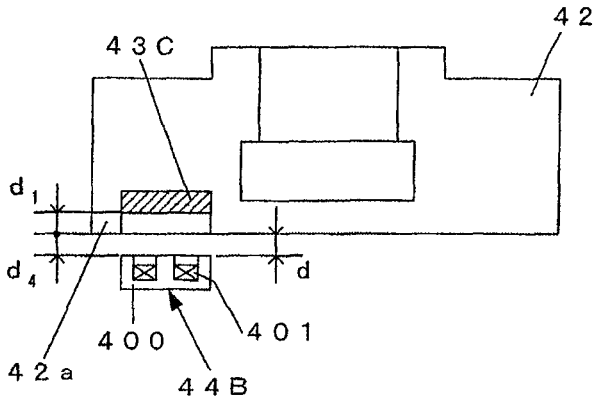
Figure 12B:
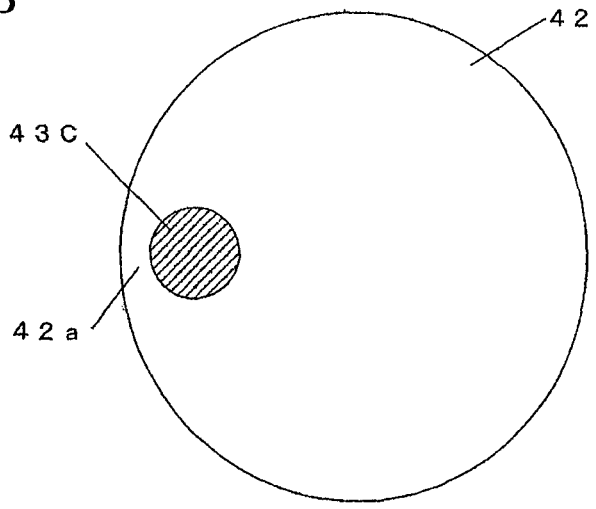

FIGS. 12A, 12B refer to a modified example 3 of the turbo-molecular pump. FIG. 12A is a cross sectional view of the nut 42 and the gap sensor 44B and FIG. 12B is bottom face of the nut 42. The structure of the pump main body 1, other than the nut 42 and the gap sensor 44B, is the same as that shown in FIG. 1. Of target 43C, only an exposed surface having a size d4 is depressed, rather than the bottom face of the nut 42. As a result, in the case of T<Tc, when the nut 42 rotates, the inductance L changes according to the position of the gap sensor 44B as the following formula.

(Opposed to Bottom Face of Nut 42) $L=N^2\cdot\mu o\cdot S/d$ (Opposed to Target 43*c*) $L3=N^2\cdot\mu o\cdot S/(d+d_4)$ On the other hand, in the case wherein the rotor temperature T is T≥Tc, the inductance L changes as the following formula. At this time, sizes of the inductances L, L3, L4 are L>L3>L4.

Figure 13:
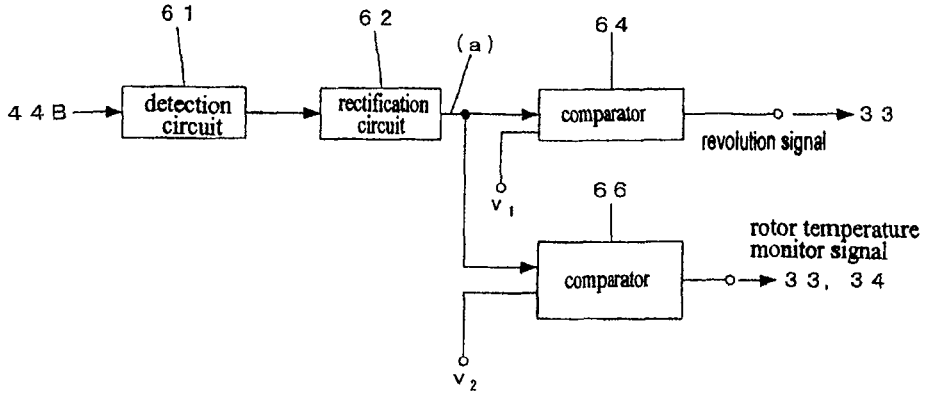
FIG. 13 is a block diagram of a detecting portion according to the third example.
Figure 14A:
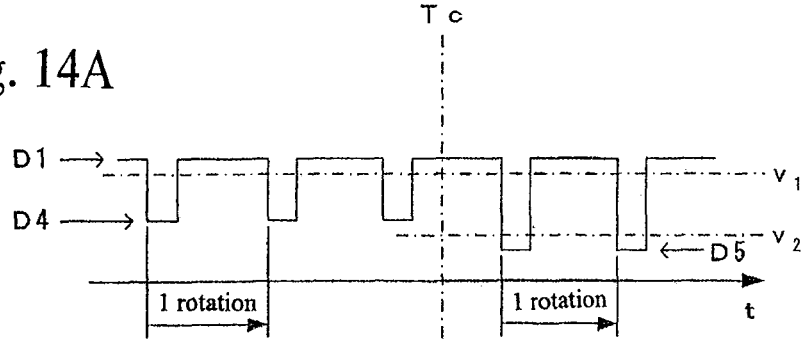
FIGS. 14A-14C show waveforms according to the block diagram of FIG. 13.
Figure 14B:
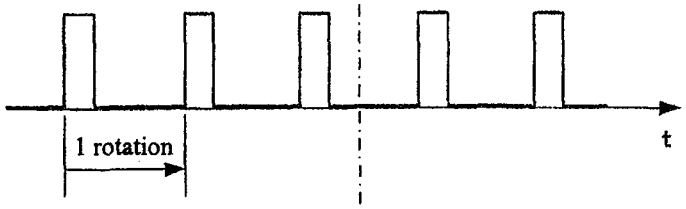
Figure 14C:
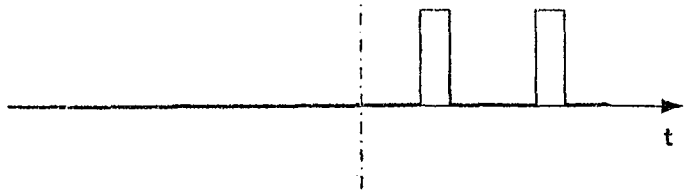

(Opposed to Bottom Face of Nut 42) $L=N^2\cdot\mu o\cdot S/d$ (Opposed to Target 43*C*) $L4=N^2\cdot\mu o\cdot S/(d+D_1+d_4)$ FIG. 13 shows a block diagram of the detecting portion 31. The window comparator 65 in the block diagram shown in FIG. 10 is replaced with a comparator 66. FIG. 14 show signal waveforms (a)-(c) referenced in FIG. 13. In signal (a) of FIG. 14, a level D4 is output when the inductance is L3, and signals of levels D5 are output when the inductance is L4.

The comparator 64 compares an input signal with the threshold $V_1$, and when the level of the signal exceeds the threshold $V_1$, the comparator 64 outputs a signal of level H, and when the level of the input signal is decreased less than the threshold $V_1$, the comparator 64 outputs a signal L. Since both signal levels D4, D5 are smaller than the threshold $V_1$, pulse signals corresponding to the signal levels D4, D5 are generated in the revolution signal which is output from the comparator 64, as shown in FIG. 14B. These pulses are generated every time when the rotor 2 makes one rotation.

On the other hand, the comparator 66 that detects the temperature monitor signal compares the input signal with the threshold $V_2$ which is lower than the threshold $V_1$, and when the signal levels exceed the threshold $V_2$, the signal level H is output, and when the signal levels are smaller than the threshold $V_2$, the signal level L is output. In this case, as shown in signal (c) of FIG. 14, the signals of level D5 are output only when the rotor temperature T exceeds the Curie temperature Tc. As a result, a pulse is also generated only at the time of T≥Tc. More specifically, whether or not the rotor temperature T is T≥Tc can be determined by detecting the pulse.

Even in the modified example 3, since the gap sensor 44B is used as the revolution sensor and also the rotor temperature monitor sensor, the modified example 3 can have the same effects of the modified example 2.

In the above-mentioned modified example 1, the ring-shaped targets 43, 43B are overlapped in an axial direction. However as shown in the relationship between the target 43C and the depression 42*b* shown in FIGS. 9A, 9B, the targets 43, 43B may be arranged separately in an axisymmetric position.

The technique shown in the modified example 1 wherein two kinds of ferromagnetic bodies, whose Curie temperatures differ are the targets for a temperature monitor, or in the modified examples 2 and 3, wherein the gap sensor is also used for a sensor detecting the change of the magnetic permeability of a temperature monitor target and revolution, is not limited to the vacuum pump wherein the target for the temperature monitor is provided in the end face as described in the above. A conventional ferromagnetic body ring can be also applied to a device with a type of being provided around the rotor. Furthermore, provided that the above disclosed features are provided, the present invention is not limited to the above-mentioned embodiment.

Non-limiting, the motor drive control portion 33 comprises a control means for controlling the operation of the motor; the target 43 in FIG. 7 comprises the first ferromagnetic body; and the target 43B comprises the second ferromagnetic body, respectively.

The disclosure of Japanese Patent Application No. 2004-271680 filed on Sep. 17, 2004 is incorporated by reference in its entirety.

While the invention has been explained with reference to the specific embodiments of the invention, the explanation is illustrative and the invention is limited only by the appended claims.

What is claimed is:

1. A vacuum pump configured to exhaust gas by rotating a rotor relative to a stator, comprising:

a first ferromagnetic body provided on an end face in a rotational axis direction of a rotational body including said rotor and provided coaxial with a rotational axis, the first ferromagnetic body having a Curie temperature equal to an allowable temperature, which generates a creep deformation in a rotor material of said rotor;

a second ferromagnetic body provided on the end face in the rotational axis direction of said rotor and provided coaxial with the rotational axis, the second ferromagnetic body having a Curie temperature higher than the Curie temperature of the first ferromagnetic body;

an inductance-type gap sensor provided to face said first and said second ferromagnetic bodies, and configured to detect a change in a magnetic permeability of said first and said second ferromagnetic bodies as inductance changes respectively; and a controller having a motor drive control portion controlling a motor to drive the rotor, and to stop a rotation of the rotor when the change in the magnetic permeability of said second ferromagnetic body is detected, or when a total time, wherein the change of the magnetic permeability of said first ferromagnetic body is detected, exceeds a predetermined allowable time based on a creep life design of said rotor.

2. A vacuum pump according to claim 1, further comprising a nut present at a lower end of the rotor, wherein the first ferromagnetic body and the second magnetic body are present in a lower end part of the nut.

3. A vacuum pump according to claim 2, wherein the first ferromagnetic body is in a ring-shape.

4. A vacuum pump according to claim 1, wherein the controller further includes a magnet-bearing drive control portion controlling magnet bearings.

5. A vacuum pump configured to exhaust gas by rotating a rotor relative to a stator, comprising:

a first ferromagnetic body provided on an end face in a rotational axis direction of a rotational body including said rotor and provided coaxial with a rotational axis, the first ferromagnetic body having a Curie temperature equal to an allowable temperature, which generates a creep deformation in a rotor material of said rotor;

a second ferromagnetic body provided on the end face the rotational axis direction of said rotor, the second ferromagnetic body having a Curie temperature higher than the Curie temperature of the first ferromagnetic body;

an inductance-type gap sensor provided to face said first and said second ferromagnetic bodies, and configured to detect a change in a magnetic permeability of said first and said second ferromagnetic bodies as inductance changes respectively; and a motor configured to drive the rotor, and to stop a rotation of the rotor when the change in the magnetic permeability of said second ferromagnetic body is detected, or when a total time, wherein the change of the magnetic permeability of said first ferromagnetic body is detected, exceeds a predetermined allowable time based on a creep life design of said rotor.

* * * * *